US012716314B2

(12) United States Patent
Mueller et al.

(10) Patent No.: US 12,716,314 B2
(45) Date of Patent: Aug. 25, 2026

(54) UNLIMITED STAGE COMPLETION SYSTEM

(71) Applicant: Packers Plus Energy Service, Inc., Calgary (CA)

(72) Inventors: Mitchell Mueller, Tomball, TX (US); Andrew Cayson, Tomball, TX (US); Javier Bolivar, Tomball, TX (US); Matthew Skinner, Edmonton (CA)

(73) Assignee: Packers Plus Energy Service, Inc., Calgary (CA)

( * ) Notice: Subject to any disclaimer, the term of this patent is extended or adjusted under 35 U.S.C. 154(b) by 0 days.

(21) Appl. No.: 18/596,779

(22) Filed: Mar. 6, 2024

(65) Prior Publication Data

US 2024/0301763 A1 Sep. 12, 2024

Related U.S. Application Data

(60) Provisional application No. 63/450,137, filed on Mar. 6, 2023.

(51) Int. Cl.
*E21B 23/04* (2006.01)
*E21B 33/12* (2006.01)

(52) U.S. Cl.
CPC ..... *E21B 33/12* (2013.01); *E21B 23/0413* (2020.05)

(58) Field of Classification Search
CPC ..... E21B 23/0413; E21B 33/12
See application file for complete search history.

(56) References Cited

U.S. PATENT DOCUMENTS

| | | | | |
|---|---|---|---|---|
| 5,014,782 | A * | 5/1991 | Daspit | E21B 33/1295 166/134 |
| 9,835,003 | B2 * | 12/2017 | Harris | E21B 33/1208 |
| 9,896,901 | B2 * | 2/2018 | Sommers | E21B 33/134 |
| 10,233,720 | B2 * | 3/2019 | Tse | E21B 33/129 |
| 11,028,666 | B2 * | 6/2021 | Sommers | E21B 33/129 |
| 11,131,162 | B2 * | 9/2021 | Hern | E21B 33/128 |
| 11,821,281 | B2 * | 11/2023 | Swor | E21B 33/13 |
| 2018/0328130 | A1 * | 11/2018 | Smith | E21B 33/1293 |

FOREIGN PATENT DOCUMENTS

WO WO-2019023493 A1 * 1/2019 ..... E21B 23/06

* cited by examiner

*Primary Examiner* — Matthew R Buck
(74) *Attorney, Agent, or Firm* — Prince Lobel Tye LLP

(57) ABSTRACT

A device such as a smart dart is configured to reversibly engage and disengage with a seat in a tubing string. In an engaged configuration, pressure applied above the device forces a first seat component to engage a second seat component. The interaction of the first seat component and the second seat component under pressure produces an inwardly radial circumferential force that grips the device within the seat and may also form a seal between the device and the seat.

7 Claims, 7 Drawing Sheets

UNLIMITED STAGE COMPLETION SYSTEM

TECHNICAL FIELD

The present application relates to an apparatus and method for wellbore tools and more particularly to isolation of wellbore zones and/or actuation of wellbore tools and methods relating thereto.

BACKGROUND OF THE INVENTION

A number of oil and gas wellbore operations are implemented using a tubing string inserted in the wellbore. In some cases, the tubing string may include tools activated by a device (such as a ball or dart) conveyed to the tool from the surface. These device-activated tools typically include a seat on which the device can land to create a seal so that pressure can be increased above the device to actuate a tool or to isolate a section of the well.

In conventional device-activated systems, the seat typically must include an area (such as a shoulder) to engage the device, which may itself be actuatable to selectively engage and disengage the seat (e.g., a "smart dart"). A well operator may then increase pressure above the seated device to actuate the selected tool or isolate a zone.

One drawback of such systems is that the seat engagement area is typically of a smaller inner diameter than the rest of the tubing string, hence restricting flow therethrough.

Another drawback of such conventional systems is that the seat engagement area typically can support a maximum pressure exerted above the device that may be insufficient for particular operations or conditions, and hence may fail if a higher pressure is applied.

A need therefore exists for a seat apparatus that can reduce flow restrictions therethrough and can also support a device seated therein at higher pressures than conventional systems.

SUMMARY OF THE INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure may contain terms such as "upstream," "downstream," "upper," and "lower" to convey relative position within a wellbore. Those of ordinary skill in the art will appreciate that such terms are used with respect to orientation with an upstream wellhead and a downstream toe end, which orientation may be vertical, horizontal, or otherwise.

According to a first embodiment of the present disclosure, there is provided a device configured to target a location in a wellbore comprising a seat. The device may comprise a first substantially cylindrical body having a first outer diameter at a lower (downstream) end and a second outer diameter at an upper (upstream) end, and a shoulder therebetween. The first outer diameter may be equal to or greater than the second outer diameter.

The device may further comprise a substantially cylindrical shell positioned around at least a portion of the upper end of the first substantially cylindrical body in substantially surrounding relation thereto, the substantially cylindrical shell including a frustoconical lower end. The upper end of the first substantially cylindrical body may be nested within the substantially cylindrical shell. An actuator may be positioned within the device in engaging relation with the substantially cylindrical shell for actuation thereof (as explained more fully below).

The device may further comprise an annular member positioned around at least a lower portion of the frustoconical lower end of the substantially cylindrical shell in contact therewith, the annular member configured to have an adjustable diameter.

Wherein the substantially cylindrical shell is axially translatable towards and away from the shoulder by operation of an actuator within the device, and wherein the diameter of the annular member is configured to increase when the substantially cylindrical shell is translated toward the shoulder, and to decrease when the substantially cylindrical shell is translated away from the shoulder.

Further according to the first embodiment of the present disclosure, there is provided a wellbore tool including a substantially cylindrical lower seat member including a first annular bevel extending around an upper end thereof and a cylindrical upper seat member having a first inner diameter at an upper end extending toward a shoulder and a second, smaller inner diameter extending from the shoulder toward a lower end, the upper seat member lower end including a second annular bevel configured to mate against the first annular bevel of the lower seat member.

Wherein the upper seat member is configured to receive an axial force against the shoulder directed toward the lower seat member and transfer at least a portion of the axial force into a radial force directed circumferentially toward a central axis of the upper seat member.

Wherein the axial force may be provided via the annular member of the device, and the region of the upper seat member proximate the beveled interface may "squeeze" the device around at least a portion of a circumference of the lower end of the upper portion of the device. Alternatively, the beveled interface may be configured such that bevel of the lower portion of the device may interact with the bevel of the upper portion of the device in the opposite orientation, i.e., such that the upper portion of the lower seat member may squeeze the device.

According to a second embodiment of the present disclosure, the upper seat member, the lower seat member, or both the upper seat member and the lower seat member are axially translatable with respect to each other such that the first annular bevel and the second annular bevel may be separated from each other upon actuation such that the axial force is no longer applied to the interface.

According to a third embodiment of the present disclosure, the upper seat member and lower seat member initially may be spaced a distance apart from each other, with one or both of the upper seat member and the lower seat member being axially translatable with respect to the other wherein the first annular bevel and the second annular bevel are separated from each other until the upper seat member, the lower seat member, or both are actuated to translate toward the other. An axial force delivered from a device (e.g., a dart) may then be translated into an inwardly radial circumferential force as with the first embodiment.

According to a fourth embodiment of the present disclosure, there is provided a device configured to target a location in a wellbore comprising a seat. The device may comprise a first substantially cylindrical body having a first outer diameter at a lower (downstream) end and a second outer diameter at an upper (upstream) end, and a shoulder therebetween. The first outer diameter may be equal to or greater than the second outer diameter.

The device may further comprise a substantially cylindrical shell positioned around at least a portion of the upper end of the first substantially cylindrical body in substantially surrounding relation thereto, the substantially cylindrical shell including a frustoconical lower end. The upper end of the first substantially cylindrical body may be nested within the substantially cylindrical shell. An actuator may be positioned within the device in engaging relation with the substantially cylindrical shell for actuation thereof (as explained more fully below).

The device may further comprise an annular member positioned around at least a lower portion of the frustoconical lower end of the substantially cylindrical shell in contact therewith, the annular member configured to have an adjustable diameter.

Wherein the substantially cylindrical shell is axially translatable towards and away from the shoulder by operation of an actuator within the device, and wherein the diameter of the annular member is configured to increase when the substantially cylindrical shell is translated toward the shoulder, and to decrease when the substantially cylindrical shell is translated away from the shoulder.

Further according to the fourth embodiment of the present disclosure, there is provided a wellbore tool including a first inner diameter at a lower end and a second inner diameter at an upper end, and a shoulder therebetween. The first inner diameter may be smaller than the second inner diameter. The wellbore tool is further configured to receive pressure (from fluid within the wellbore, for example) around its outer diameter, including in a region of circumferentially reduced thickness generally corresponding to a location wherein the wellbore tool may exert an inwardly radial circumferential force on the device to "squeeze" the device in response to the received pressure around its outer diameter.

Wherein the shoulder is configured to receive the annular member of the device to engage with and fix the device in place.

Wherein a higher pressure may subsequently be applied above the device, creating a differential pressure across the device.

Wherein the higher upstream pressure may slightly constrict the region of circumferentially reduced thickness of the wellbore tool thereby to force the area of reduced thickness of the wellbore tool to exert an inwardly radial force circumferentially around at least a portion of the lower end of the device so as to "squeeze" the device in place.

According to a fifth embodiment of the present disclosure, the area of reduced thickness of the wellbore tool of the fourth embodiment may be replaced with a dog or key that may be acted upon by the higher upstream pressure thereby to engage the dog or key to exert an inwardly radial force circumferentially around at least a portion of the lower end of the device so as to "squeeze" the device in place.

According to a sixth embodiment of the present disclosure, the region of the wellbore tool and the corresponding region of the device at which the radial circumferential force is applied may also be configured to form a seal therebetween.

BRIEF DESCRIPTION OF DRAWINGS

The drawings accompanying and forming part of this specification are included to depict certain aspects of the present invention. A clearer impression of the invention, and of the components and operation of systems provided with the present invention, will become more readily apparent by referring to the exemplary, and therefore non-limiting, embodiments illustrated in the drawings, wherein identical reference numerals designate the same components. Note that the features illustrated in the drawings are not necessarily to scale.

DETAILED DESCRIPTION OF THE INVENTION

Figure 1:
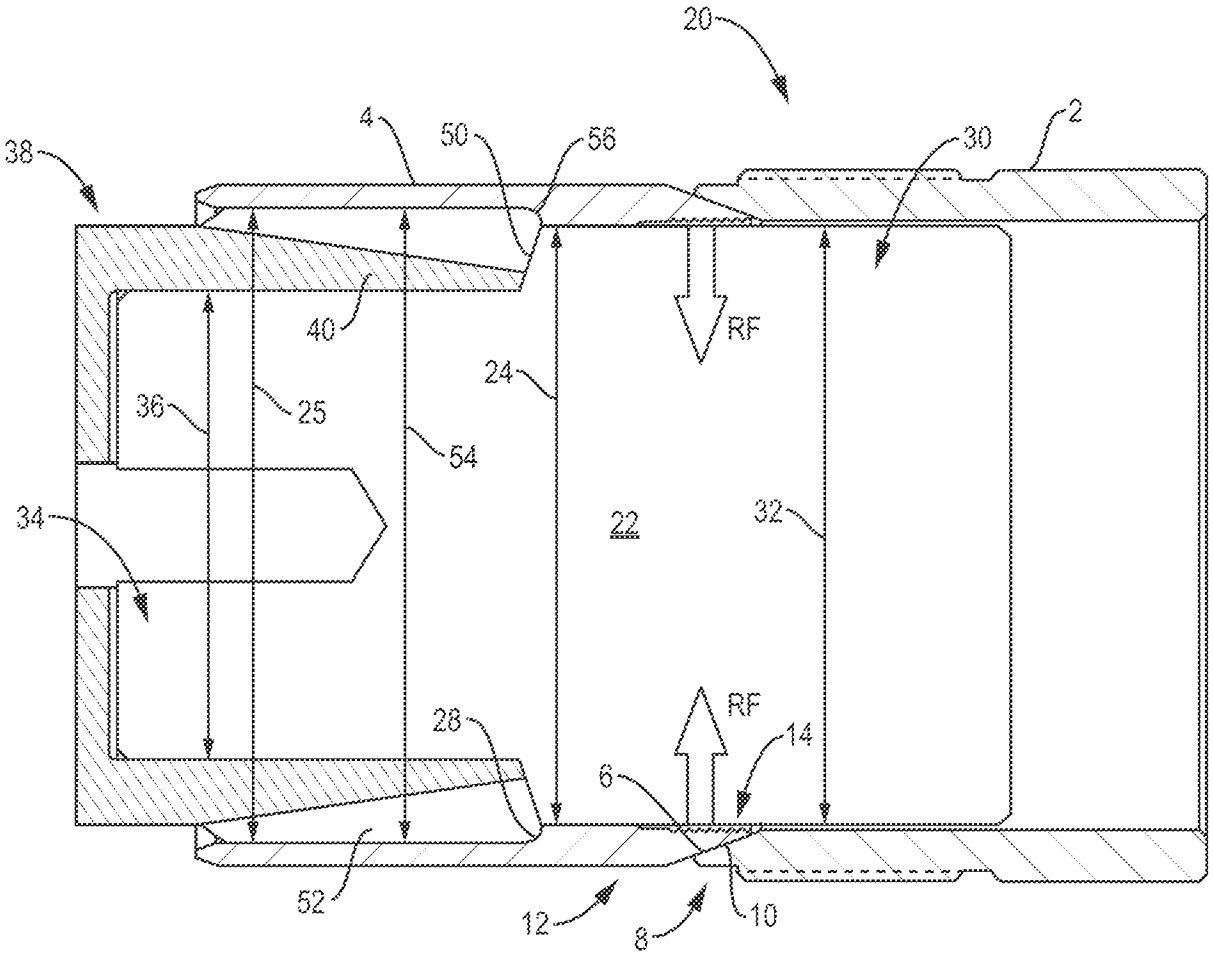
FIG. 1 depicts a bisectional view of a device seated within a wellbore tool according to a first embodiment of the present invention.

In FIG. 1 there is depicted a bisectional view of a first exemplary embodiment of a well plug system according to the invention. The well plug system of this embodiment includes a first component 20 comprising a lower seat section 2 and an upper seat section 4 suitable for reversable engagement/disengagement with a complimentary device (e.g., a dart) 22 as explained further below. The drawing is orientated such that the wellhead is to the left and the toe of the wellbore is to the right.

The lower seat section 2 includes an interiorly slanted bevel 6 about its upper end 8. The upper seat section 4 includes a complimentary exteriorly slanted bevel 10 about its lower end 12. In FIG. 1, the orientation of the complementary bevels is arbitrarily selected such that the beveled lower end 12 of the upper seat section 4 is positioned within the beveled upper end 8 of the lower seat section 2, but those of ordinary skill will appreciate that the opposite orientation is also suitable for purposes of the invention.

The inner circumference surface 14 of the lower end 12 of the upper seat section 4 may, but need not, include knurling (or other surface roughening) around all or part of the inner circumference surface 14 thereof. As explained further below, in some embodiments the knurling (or other roughening) of area 14 is configured to engage with an outer surface of a device (e.g., dart 22) to effectuate plugging of a well pipe (not shown). Further in view of FIG. 1, the surfaces of bevels 6 and 10 are configured to mate in a male/female arrangement about substantially the entire circumference of the first component 20 such that the two surfaces of bevels 6 and 10 are at least partially slidable against each other as explained further below.

The upper seat section 4 also comprises a first inner diameter 24, a second inner diameter 25, and a shoulder 28 therebetween. As depicted in FIG. 1, in an embodiment the second inner diameter 25 is larger than the first inner diameter 24.

With continuing reference to FIG. 1, there is also depicted a second well plug system component: device 22. In a preferred embodiment the device 22 may be a dart (as would be understood by those of skill in the art) conveyable through a tubing string, but the invention is not limited to the second component 22 comprising a dart. The device 22 includes a lower region 30 having a first outer diameter 32 and an upper region 34 having a second outer diameter 36. As can be seen in FIG. 1, in an embodiment the second outer diameter 36 is smaller than the first outer diameter 32. A shoulder 50 is positioned between the lower region 30 and the upper region 34.

Still referring to FIG. 1, a cup-shaped subcomponent 38 is positioned in male/female relation about at least a portion of the upper region 34 of the device 22. The cup-shaped subcomponent 38 includes a frustoconical lower end 40. As further described below, the cup-shaped subcomponent is axially translatable towards and away from the shoulder 50 by an actuator (not shown) within the device 22. In a preferred embodiment the actuator may be a linear actuator, but the type of actuator used can be any known or future type of actuator useful for translating the cup-shaped subcomponent 38 forward or backward (i.e., left and right as depicted in FIG. 1) along the upper region 34 of the device.

Situated around the frustoconical lower end 40 of the cup-shaped subcomponent 38 and in radially translatable relation therewith is an annular component 52. As explained further below, the annular component 52 is configured to have an adjustable diameter suitable for slidable relation about the frustoconical lower end 40 of the cup-shaped subcomponent 38. As depicted in FIG. 1, the device 22 is seated within the first component 20.

Having now described the components and subcomponents of the well plug system of the invention, a mode of operation of a preferred embodiment will be presented next. When the device (e.g., dart) 22 (or other like device) is in a first configuration (See FIG. 2), the cup-shaped subcomponent 38 is positioned away from the shoulder 50 such that annulus 52 has an outer diameter that is not greater than the outer diameter 32 of the lower portion 30 of the device (e.g., dart) 22. Thus, in the first configuration the device 22, which comprises an outer diameter 32 smaller than the inner diameter 24 of the first component 20, may pass through the first component 20 unimpeded.

In a second configuration (as depicted in FIG. 1), the cup-shaped subcomponent 38 is positioned closer to the shoulder 50 such that annulus 52 is urged to radially expand to have an outer diameter 54 that is greater than the outer diameter 32 of the lower portion 30 of the dart 22.

As depicted in FIG. 1, in the second configuration, when the device (e.g., dart) 22 enters the first component 20, the forward lip 56 of annulus 52 engages the shoulder 28 of the upper seat 4. This engagement urges the upper seat section 4 toward lower seat section 2, which in turn urges the beveled surface 10 of the lower portion 12 of upper seat portion 4 to slide up against the beveled surface 10 (as orientated in FIG. 1) of the upper portion 8 of the lower seat portion 2. This in turn creates an inward circumferential radial force (RF) in the lower end 12 of the upper seat portion 4. This results in a normal force being applied against the outer diameter 32 of the dart 22, "squeezing" it and fixing it into place, which may effectively plug the well at that location. Ordinary well operations (e.g., completion, etc.) may subsequently be conducted as would be apparent to those of ordinary skill in the art.

Figure 2:
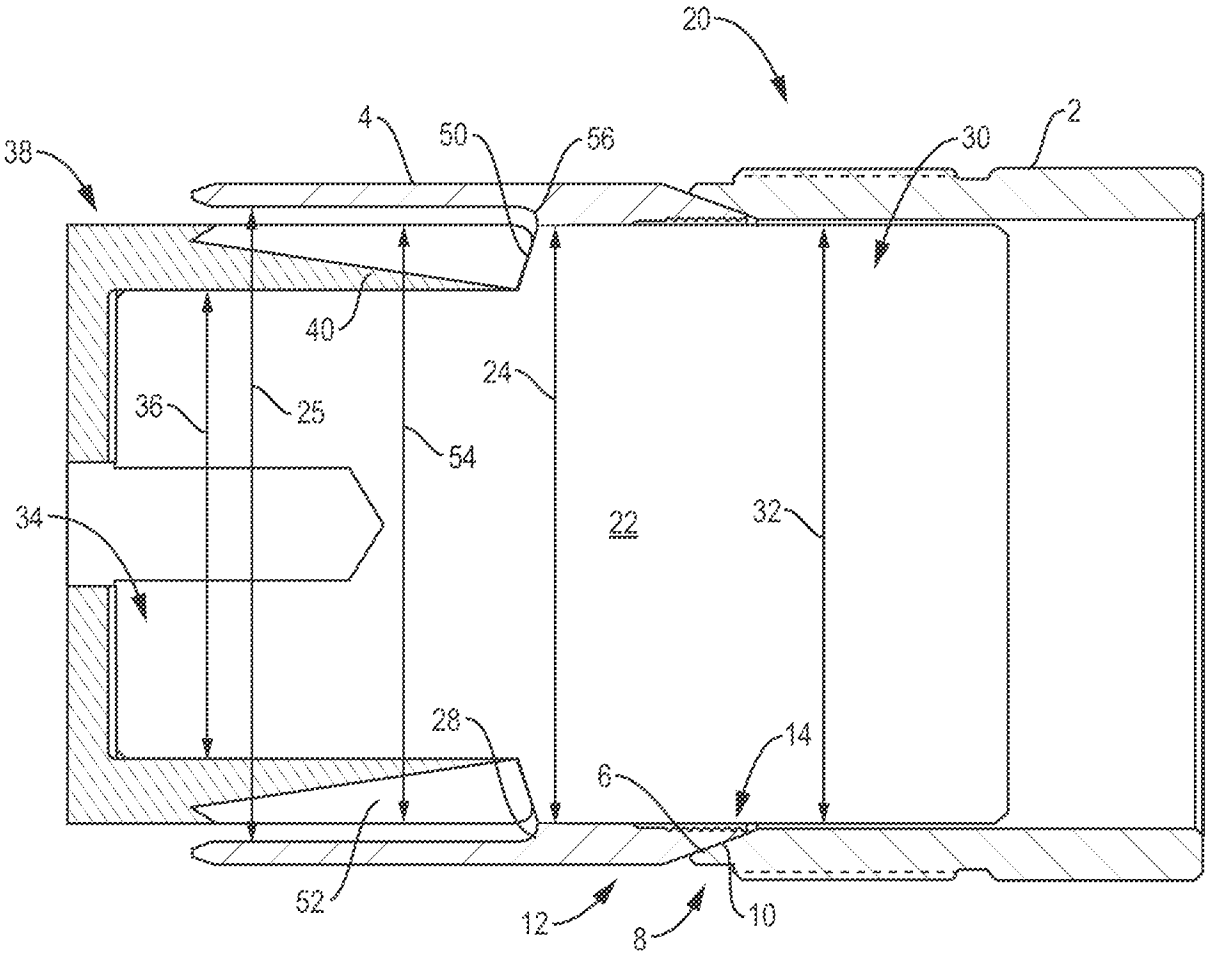
FIG. 2 depicts a bisectional view of the device unseated within the wellbore tool according to the first embodiment of the present invention.

If it becomes desirable to unplug the well pipe, the cup-shaped subcomponent 38 can be actuated to slide away from the shoulder 50, thereby allowing the annulus 52 to contract, causing its outer diameter 54 to be the same as (or smaller than) the outer diameter of the lower portion 30 of the dart 22 as depicted in FIG. 2. This, in turn, allows the dart 22 to travel unimpeded through the first component 20 (downstream or upstream) and hence for the well pipe to be unplugged at that location.

It should be appreciated by those of ordinary skill in the art that the well plug system of the invention thus provides for a practically unlimited number of well pipe stages to be introduced into a well because all of the seat components can comprise identical inner diameters, thus overcoming a limitation existing in prior art systems that utilize variable sized balls and ball seats. An additional advantage of the arrangement of this embodiment is the ability to increase pressure upstream of the device 22, with such increasing pressure serving to further increase the inwardly radial circumferential force (Rf), which further increases the "grip" of the first component 20 on the device 22.

The above embodiment uses the relative movement of the bevels between the lower seat portion 2 and upper seat portion 4 to create the radial reaction force. As depicted below, another method to seat the device 22 (e.g., dart) using circumferential force against the body of the device may be by using a higher pressure from above the device 22 that occurs when the device 22 has been locked in place after the interaction of the forward lip 56 of the annular member 52 against the shoulder 28 of the upper portion 4 of the first component 20.

Figure 7:
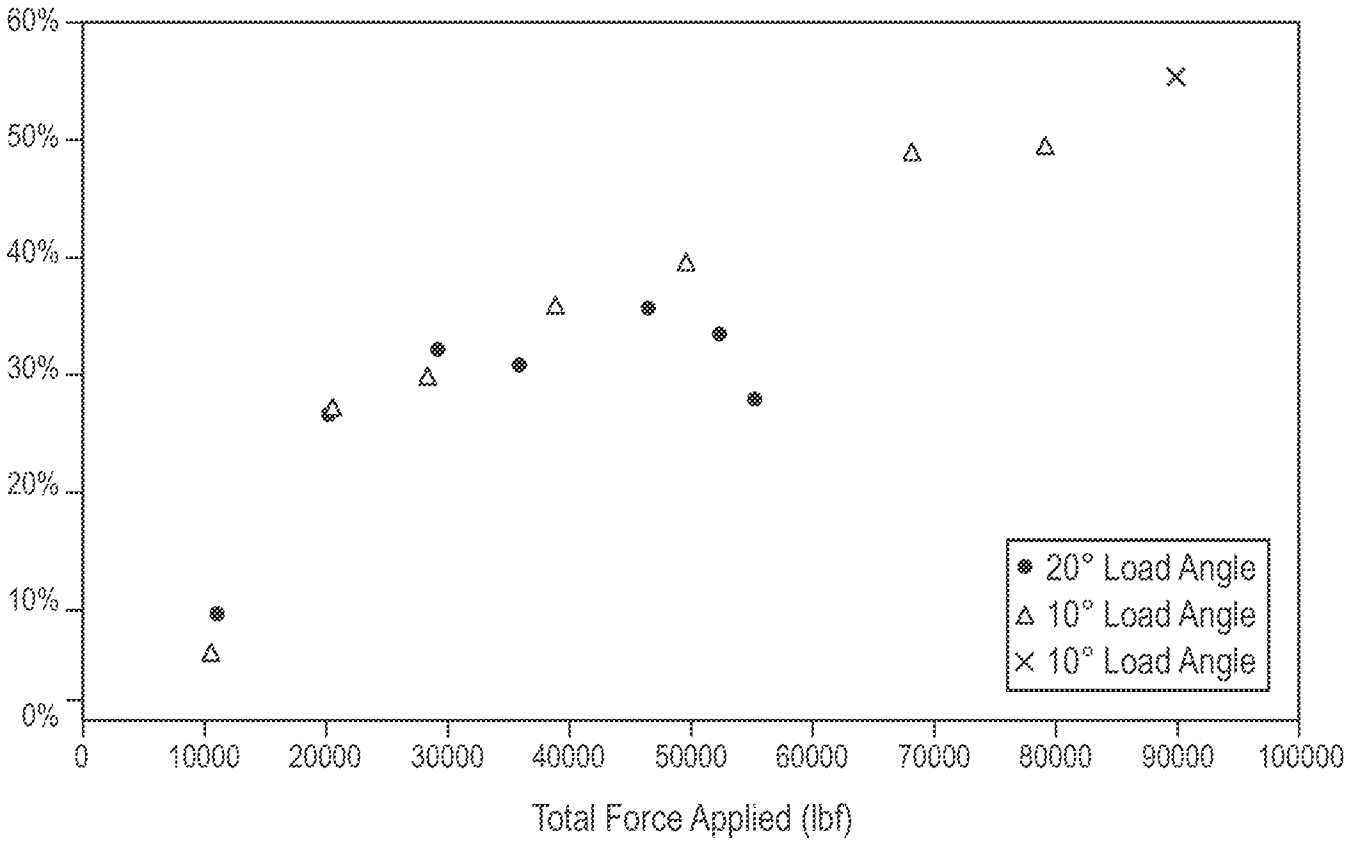
FIG. 7 depicts a graph of a percentage of a total force applied to a device seated within a wellbore tool that is translated into an inwardly radial circumferential force according to a broad aspect of the present invention.

As demonstrated in FIG. 7, the inventors have discovered that, at least under lower load angles (i.e., the angle of the interface between bevels 6 and 10 of lower seat section 4 and upper seat section 2, respectively), the percentage of load that is transferred to create the circumferential inwardly radial force Rf increases with increasing pressure applied above the device 22. As can be seen in FIG. 7, the seat 20 and device 22 is not only able to handle greater pressure forces, but it actually increases the total percentage of load that is used to "grip" the device 22 within the seat 20. The load angle is preferably between 5 degrees and 25 degrees. The load angle is more preferably between 10 degrees and 20 degrees, and the load angle is most preferably around 10 degrees.

Figure 3:
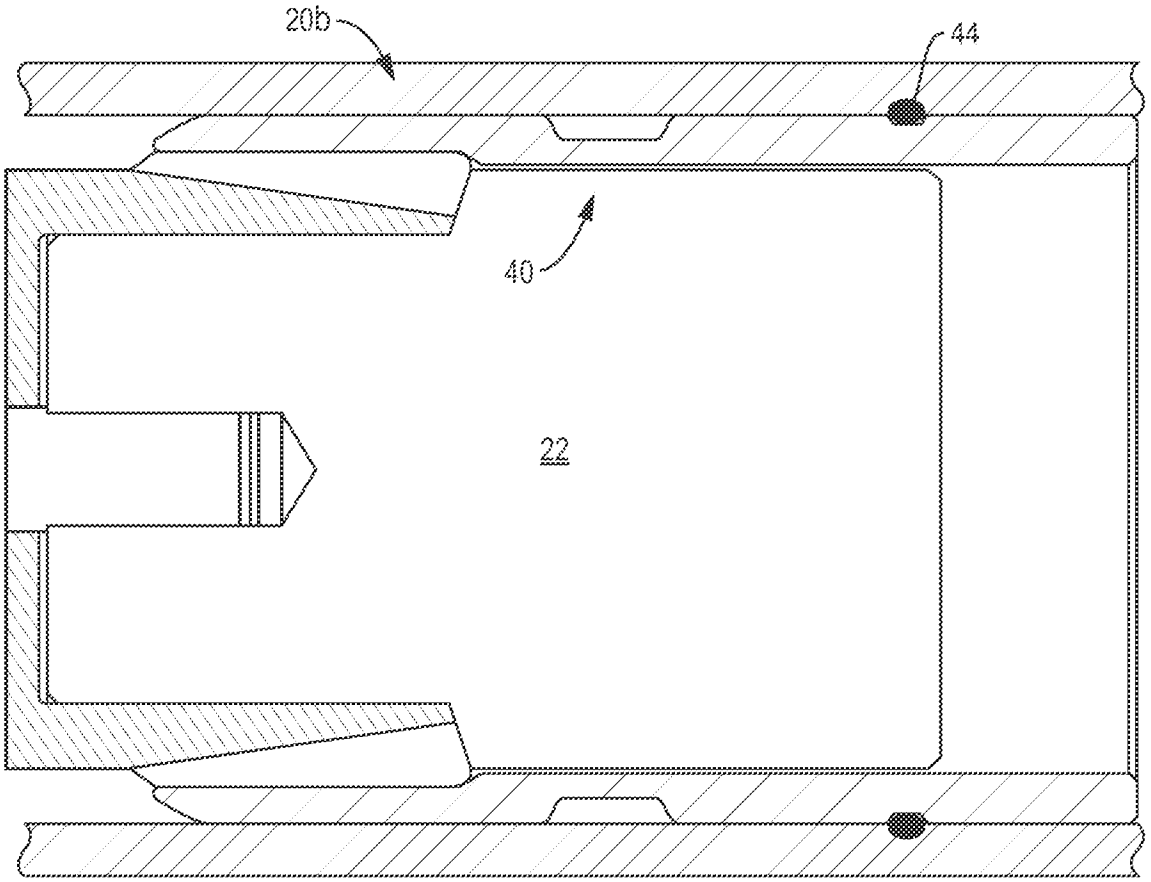
FIG. 3 depicts a bisectional view of the device seated within a wellbore tool according to an alternative embodiment of the present invention.
Figure 4:
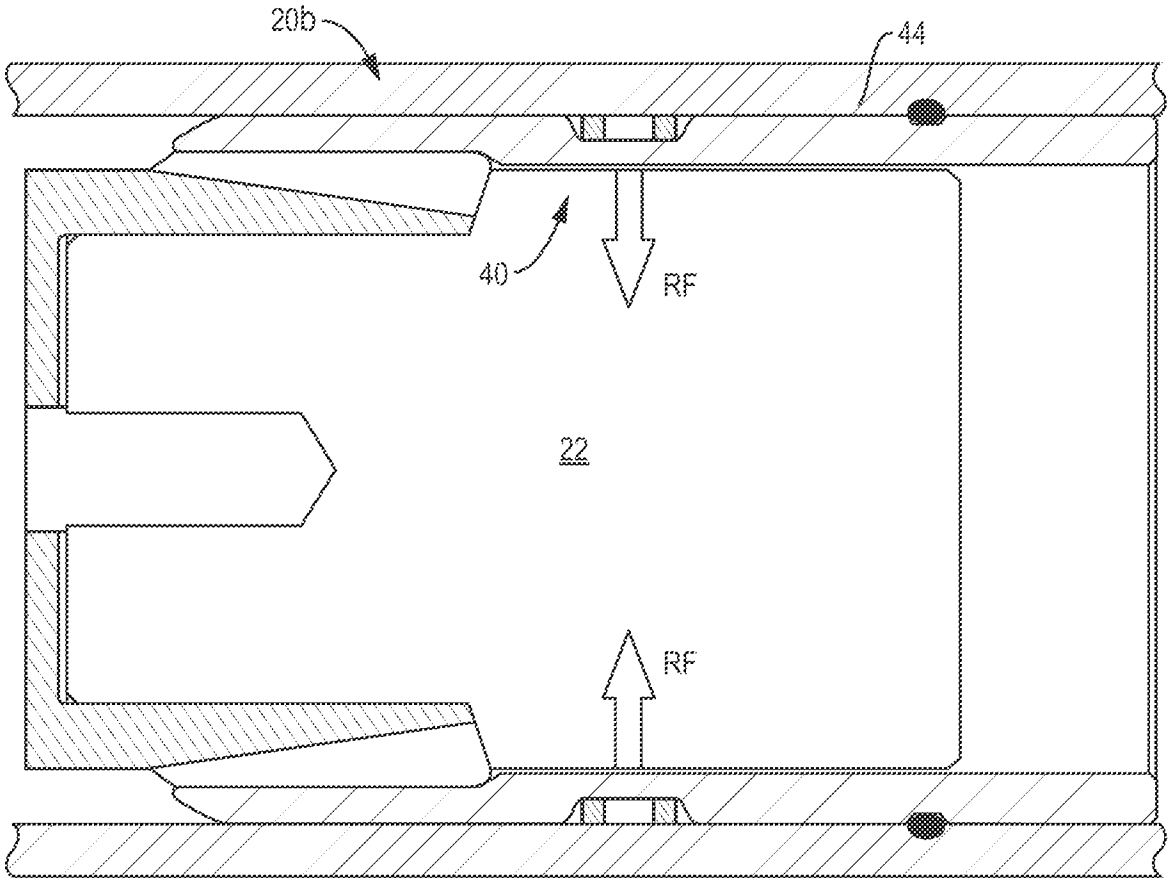
FIG. 4 depicts a bisectional view of the device seated within an alternative wellbore tool according to the alternative embodiment of the present invention.

Turning to FIG. 3, in a second embodiment, a modified first component **20*b* may comprise a unitary structure (instead of being divided into upper and lower seat sections 2, 4 as with the first embodiment). In this embodiment the mating bevels 6 and 10 of the first embodiment are replaced by an area of reduced thickness 40. In this embodiment, pressure is allowed to propagate around (but not past) the outer surface of the first component 20*b*. A seal 44 formed between the outer surface of the first component and a wall of a pipe in which the first component is positioned (for example) prevents the increased pressure from bypassing the first component. Seal 44 may comprise an O-ring, for example. A region 40 of the first component 20*b* is adapted to receive the increased pressure, thereby creating a deflection at that portion that grips the device 22 (e.g., dart) circumferentially about the outer diameter 32 of the downstream lower region 30 of the device 22 (see FIG. 1), fixing the device 22 in place as a result of said pressure in a manner similar to the interaction of the bevels in the first embodiment. As depicted in FIG. 4, in an alternative embodiment the region 40** may comprise a dog or key that applies the inwardly radial circumferential force RF.

Figure 5:
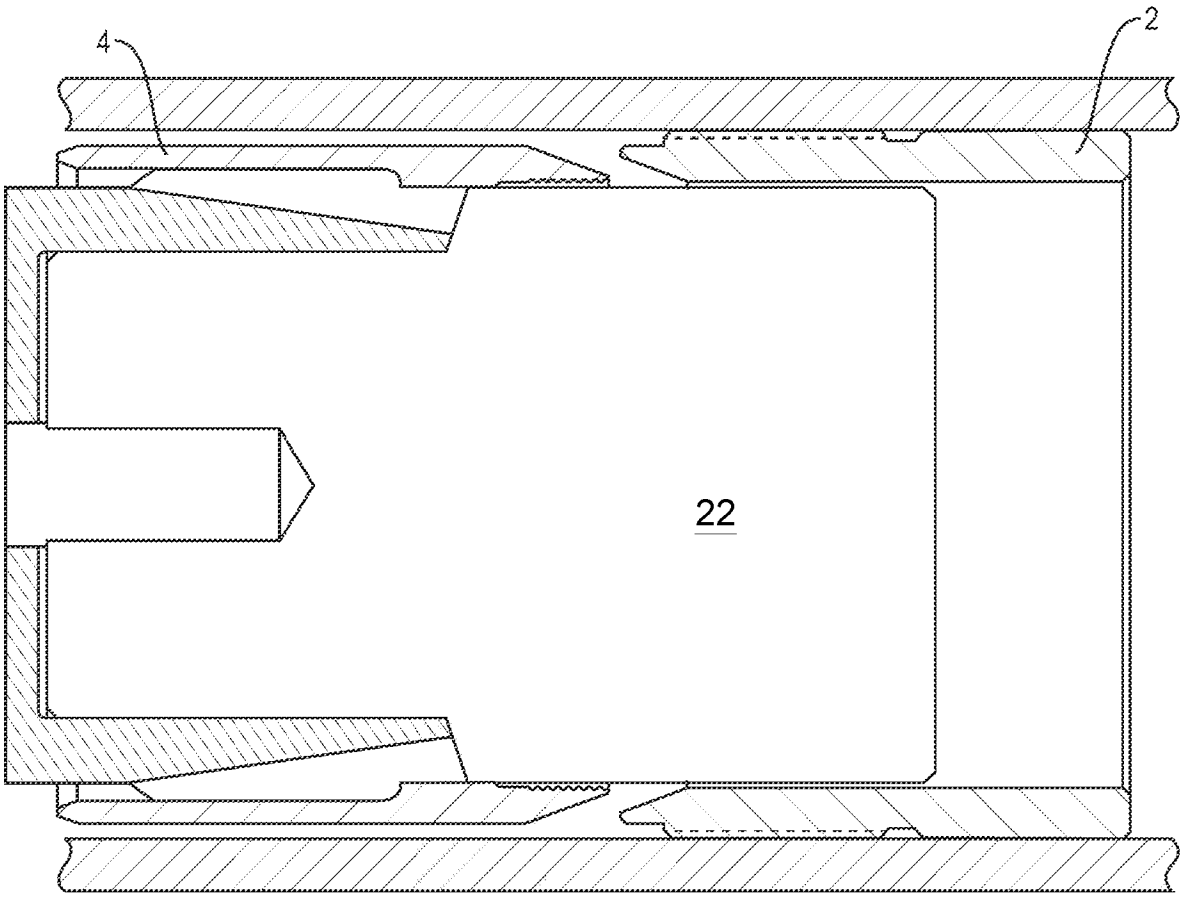
FIG. 5 depicts a bisectional view of the device seated within a wellbore tool according to a further alternative embodiment of the present invention.

In a further embodiment derived from the first embodiment depicted in FIG. 5, sections 2 and 4 of first component 20 initially are separated by a distance. When a device 22 (e.g., a dart) engages the upper seat section 4, it is prevented from traveling further downstream by the interaction of device shoulder portion 56 and upstream subcomponent shoulder 28 as with the first embodiment (see FIG. 1). In this alternative embodiment, either or both of seat sections 2 and 4 are actuatable to axially traverse toward the other to complete the arrangement depicted in the first embodiment (FIG. 1), wherein complementary bevels on seat sections 2, 4 engage to create the inwardly radial circumferential force RF (see FIG. 1). Either or both of seat sections 2 and 4 may be actuatable by any means currently available as would be understood by a person of ordinary skill, and by such other actuation means as may become available in the future. As a person of ordinary skill would appreciate, the reverse process may be applied: i.e., either or both of sections 2 and 4 may be actuated to separate from each other along an axis to cease application of the inwardly radial circumferential force RF to the device 22.

Figure 6:
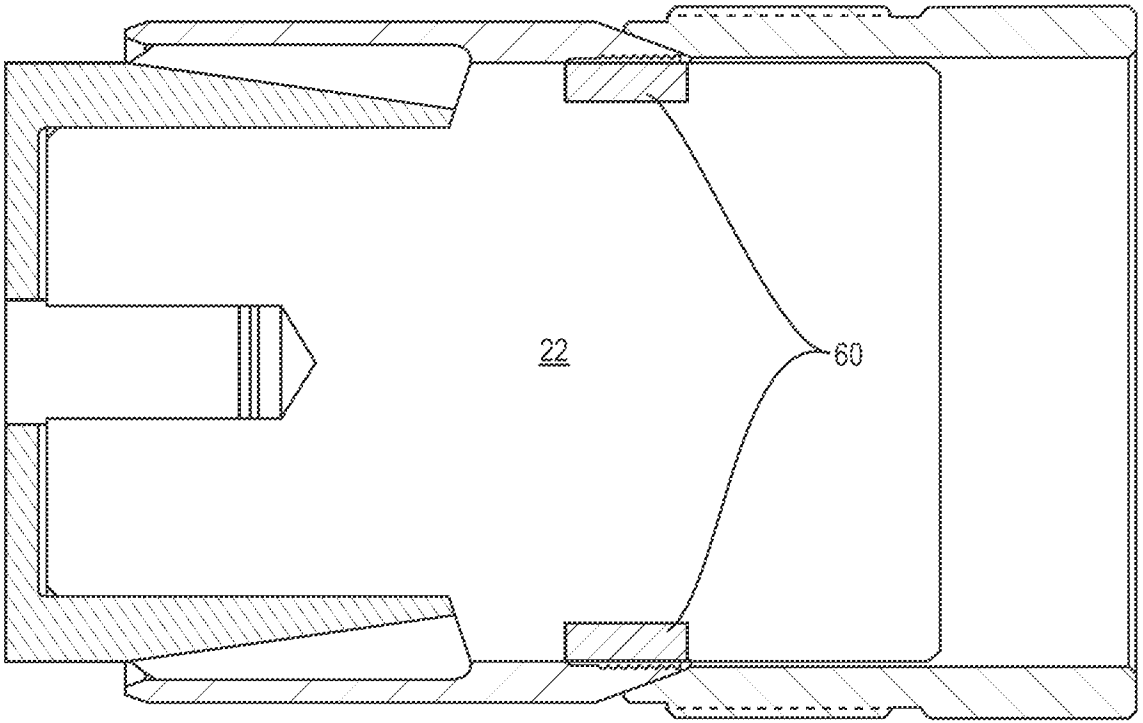
FIG. 6 depicts a device seated within a wellbore tool according to a yet further alternative embodiment of the present invention.

A further modification of the first embodiment is depicted in FIG. 6. In this embodiment, the inwardly radial circumferential force can be used instead to energize a seal between a portion of the circumference of the device 22 and the lower portion 12 of the upper portion 4 of the first component 20. This embodiment includes a modified surface 60 (comprising an appropriate material as is known in the art) about the circumference of the device 22 to create the seal between the device 22 and the first component 20. This embodiment thus is useful for fluid/gas tight sealing.

Although the invention has been described with respect to specific embodiments thereof, these embodiments are merely illustrative, and not restrictive of the invention Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

As used herein, the terms "comprises," "comprising." "includes," "including," "has," "having," or any other variation thereof, are intended to cover a non-exclusive inclusion. For example, a process, product, article, or apparatus that comprises a list of elements is not necessarily limited to only those elements but may include other elements not expressly listed or inherent to such process, product, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

The invention claimed is:

1. An apparatus for reversibly plugging a wellbore tubular including a wellbore tool and a complementary plugging device configured to reversibly mate with and release from the wellbore tool, comprising:

a first well plug component comprising:

a substantially cylindrical lower seat member including a first annular bevel extending around an upper end thereof;

a substantially cylindrical upper seat member having a first inner diameter at an upper end extending toward a shoulder and a second, smaller inner diameter extending from the shoulder toward a lower end, the upper seat member lower end including a second annular bevel configured to mate against the first annular bevel of the lower seat member, wherein the upper seat member is configured to receive an axial force against the shoulder directed toward the lower seat member;

wherein the first annular bevel and the second annular bevel are configured to transmit at least a portion of the axial force into a radial force directed circumferentially toward a central axis of the upper seat member; and a second well plug component comprising:

a first substantially cylindrical body having a first outer diameter at a lower end, a second outer diameter at an upper end, and a shoulder therebetween, the second outer diameter being smaller than the first outer diameter;

a second substantially cylindrical body positioned around the upper end of the first substantially cylindrical body in substantially surrounding relation, the second cylindrical body including a frustoconical lower end;

an annular member positioned around at least a lower portion of the frustoconical lower end of the second substantially cylindrical body in physical contact therewith, the annular member configured to have an adjustable diameter;

wherein the second substantially cylindrical body is axially translatable towards and away from the shoulder; and wherein the outer diameter of the annular member is configured to increase when the second substantially cylindrical body is translated toward the shoulder, and to decrease when the second substantially cylindrical body is translated away from the shoulder.

2. The apparatus of claim 1, further comprising:

wherein the upper seat member of the first well plug component comprises an annular region on the second inner diameter proximate the second annular bevel that is at least partially roughened.

3. The apparatus of claim 1, further comprising:

wherein the first annular bevel and the second annular bevel of the first well plug component interface at an angle between 5 degrees and 25 degrees with respect to the longitudinal axis of the well plug component from the vertical.

4. The apparatus of claim 1, further comprising:

wherein the substantially cylindrical upper seat member and the substantially cylindrical lower seat member of the first well plug component are disposed a distance apart from each other in a first configuration, and wherein the substantially cylindrical upper seat member and the substantially cylindrical lower seat member of the first well plug component are disposed such that the first annular bevel and the second annular bevel are in physical contact with each other in a second configuration.

5. The apparatus of claim 4, further comprising:

an actuator of the first well plug component is configured to convert the substantially cylindrical upper seat member and the substantially cylindrical lower seat member between one of the first configuration or the second configuration and the other of the first configuration or the second configuration.

6. The apparatus of claim 1, further comprising:

a circumferential sealing surface about the first substantially cylindrical body of the second well plug component configured to form a fluid-tight seal when seated in the first well-plug component.

7. The apparatus well plug component of claim 1, further comprising:

an actuator of the second well plug component configured to translate the second substantially cylindrical body toward and away from the shoulder.

* * * * *